US010994876B2

(12) United States Patent
Gunner et al.

(10) Patent No.: US 10,994,876 B2
(45) Date of Patent: May 4, 2021

(54) AUTOMATED WRAPPING OF COMPONENTS IN TRANSPORT STRUCTURES

(71) Applicant: DIVERGENT TECHNOLOGIES, INC., Los Angeles, CA (US)

(72) Inventors: Jon Paul Gunner, Palos Verdes Estates, CA (US); Alex James Hamade, Redondo Beach, CA (US); Narender Shankar Lakshman, Hermosa Beach, CA (US); Stuart Paul Macey, Laguna Niguel, CA (US)

(73) Assignee: DIVERGENT TECHNOLOGIES, INC., Los Angeles, CA (US)

( * ) Notice: Subject to any disclaimer, the term of this patent is extended or adjusted under 35 U.S.C. 154(b) by 180 days.

(21) Appl. No.: 16/011,583

(22) Filed: Jun. 18, 2018

(65) Prior Publication Data

US 2019/0002143 A1 Jan. 3, 2019

Related U.S. Application Data

(60) Provisional application No. 62/527,535, filed on Jun. 30, 2017.

(51) Int. Cl.
*B65B 41/14* (2006.01)
*B65B 57/06* (2006.01)
(Continued)

(52) U.S. Cl.
CPC ..... *B65B 41/14* (2013.01); *B65B 33/04* (2013.01); *B65B 35/20* (2013.01); *B65B 41/10* (2013.01);
(Continued)

(58) Field of Classification Search
CPC ..... B65B 41/10; B65B 57/14; B65B 57/12; B65B 33/04; B65B 57/04; B65B 35/20;
(Continued)

(56) References Cited

U.S. PATENT DOCUMENTS 3,581,460 A * 6/1971 Lambsdorff ..... B65B 9/026 53/526
3,777,452 A * 12/1973 Koenders ..... B65B 11/54 53/206
(Continued)

FOREIGN PATENT DOCUMENTS

WO 1996036455 A1 11/1996
WO 1996036525 A1 11/1996
(Continued)

OTHER PUBLICATIONS

US 9,202,136 B2, 12/2015, Schmidt et al. (withdrawn)
(Continued)

*Primary Examiner* — Anna K Kinsaul
*Assistant Examiner* — Chinyere J Rushing-Tucker
(74) *Attorney, Agent, or Firm* — Arent Fox LLP

(57) ABSTRACT

An automated wrapping technique for vehicle components is disclosed. A component to be wrapped is secured to a fixture, which in turn is coupled to an actuator. A grabber arm grabs a length of wrap from a feed roll. The grabber arm removes the backing and spreads the wrap over the component. The actuator pushes the component upward until the wrap contacts the component surface. An applicator may concurrently smooth the wrap and evacuate trapped air. The wrap may be cut around the periphery of the component, and hemmed. A controller provides instructions to automate the wrapping mechanism.

47 Claims, 3 Drawing Sheets

(51) Int. Cl.

| | |
|---|---|
| ***B65B 41/10*** | (2006.01) |
| ***B65B 35/20*** | (2006.01) |
| ***B65B 57/04*** | (2006.01) |
| ***B65B 57/14*** | (2006.01) |
| ***B65B 33/04*** | (2006.01) |
| ***B65B 57/12*** | (2006.01) |

(52) U.S. Cl.
CPC ..... *B65B 57/04* (2013.01); *B65B 57/06* (2013.01); *B65B 57/12* (2013.01); *B65B 57/14* (2013.01)

(58) Field of Classification Search
CPC ..... B65B 41/14; B65B 57/06; B65B 11/00; B65B 11/004; B65B 11/02; B65B 11/54; B65B 45/00; B65B 53/00; B65B 53/02; B32B 38/1866; B29C 63/04; Y10T 156/1028; Y10T 156/103; B65D 85/64; B65D 85/68
USPC ..... 53/397, 203, 556, 441, 442, 461, 580, 53/557, 218; 156/212, 213, 391, 468, 156/475, 574
See application file for complete search history.

(56) References Cited

U.S. PATENT DOCUMENTS 4,583,348 A * 4/1986 Treiber ..... B65B 11/54 53/389.3
4,828,637 A * 5/1989 Mentzer ..... B29C 37/0025 156/212
5,127,974 A * 7/1992 Tomiyama ..... C09J 7/38 156/85
5,203,226 A 4/1993 Hongou et al.
5,294,278 A * 3/1994 Matsui ..... B05D 5/00 156/248
5,383,326 A * 1/1995 Dean ..... B65B 41/14 53/556
5,730,827 A 3/1998 Sewell
5,742,385 A 4/1998 Champa
5,990,444 A 11/1999 Costin
5,997,670 A * 12/1999 Walter ..... B29C 63/0056 156/71
6,001,198 A * 12/1999 Habisreitinger ..... B65B 41/14 156/64
6,010,155 A 1/2000 Rinehart
6,050,318 A 4/2000 Roczynski et al.
6,096,249 A 8/2000 Yamaguchi
6,140,602 A 10/2000 Costin
6,189,302 B1 * 2/2001 Kudo ..... B65B 11/54 294/902
6,250,533 B1 6/2001 Otterbein et al.
6,252,196 B1 6/2001 Costin et al.
6,318,642 B1 11/2001 Goenka et al.
6,365,057 B1 4/2002 Whitehurst et al.
6,391,251 B1 5/2002 Keicher et al.
6,409,930 B1 6/2002 Whitehurst et al.
6,468,439 B1 10/2002 Whitehurst et al.
6,554,345 B2 4/2003 Jonsson
6,585,151 B1 7/2003 Ghosh
6,644,721 B1 11/2003 Miskech et al.
6,699,346 B1 * 3/2004 Habisreitinger ..... B29C 63/02 156/212
6,811,744 B2 11/2004 Keicher et al.
6,866,497 B2 3/2005 Saiki
6,899,779 B1 * 5/2005 Okada ..... B29C 53/04 156/152
6,919,035 B1 7/2005 Clough
6,926,970 B2 8/2005 James et al.
7,152,292 B2 12/2006 Hohmann et al.
7,344,186 B1 3/2008 Hausler et al.
7,500,373 B2 3/2009 Quell
7,586,062 B2 9/2009 Heberer
7,637,134 B2 12/2009 Burzlaff et al.
7,710,347 B2 5/2010 Gentilman et al.
7,716,802 B2 5/2010 Stern et al.
7,745,293 B2 6/2010 Yamazaki et al.
7,766,123 B2 8/2010 Sakurai et al.
7,852,388 B2 12/2010 Shimizu et al.
7,908,922 B2 3/2011 Zarabadi et al.
7,951,324 B2 5/2011 Naruse et al.
8,094,036 B2 1/2012 Heberer
8,096,338 B2 * 1/2012 Postill ..... B29C 63/0004 156/540
8,163,077 B2 4/2012 Eron et al.
8,286,236 B2 10/2012 Jung et al.
8,289,352 B2 10/2012 Vartanian et al.
8,297,096 B2 10/2012 Mizumura et al.
8,354,170 B1 1/2013 Henry et al.
8,383,028 B2 2/2013 Lyons
8,408,036 B2 4/2013 Reith et al.
8,429,754 B2 4/2013 Jung et al.
8,437,513 B1 5/2013 Derakhshani et al.
8,444,903 B2 5/2013 Lyons et al.
8,452,073 B2 5/2013 Taminger et al.
8,599,301 B2 12/2013 Dowski, Jr. et al.
8,606,540 B2 12/2013 Haisty et al.
8,610,761 B2 12/2013 Haisty et al.
8,631,996 B2 1/2014 Quell et al.
8,651,160 B2 * 2/2014 Urabe ..... B25J 9/1682 156/250
8,675,925 B2 3/2014 Derakhshani et al.
8,678,060 B2 3/2014 Dietz et al.
8,686,314 B2 4/2014 Schneegans et al.
8,686,997 B2 4/2014 Radet et al.
8,694,284 B2 4/2014 Berard
8,720,876 B2 5/2014 Reith et al.
8,752,166 B2 6/2014 Jung et al.
8,755,923 B2 6/2014 Farahani et al.
8,787,628 B1 7/2014 Derakhshani et al.
8,818,771 B2 8/2014 Gielis et al.
8,873,238 B2 10/2014 Wilkins
8,978,535 B2 3/2015 Ortiz et al.
9,006,605 B2 4/2015 Schneegans et al.
9,071,436 B2 6/2015 Jung et al.
9,101,979 B2 8/2015 Hofmann et al.
9,104,921 B2 8/2015 Derakhshani et al.
9,126,365 B1 9/2015 Mark et al.
9,128,476 B2 9/2015 Jung et al.
9,138,924 B2 9/2015 Yen
9,149,988 B2 10/2015 Mark et al.
9,156,205 B2 10/2015 Mark et al.
9,186,848 B2 11/2015 Mark et al.
9,244,986 B2 1/2016 Karmarkar
9,248,611 B2 2/2016 Divine et al.
9,254,535 B2 2/2016 Buller et al.
9,266,566 B2 2/2016 Kim
9,269,022 B2 2/2016 Rhoads et al.
9,327,452 B2 5/2016 Mark et al.
9,329,020 B1 5/2016 Napoletano
9,332,251 B2 5/2016 Haisty et al.
9,346,127 B2 5/2016 Buller et al.
9,389,315 B2 7/2016 Bruder et al.
9,399,256 B2 7/2016 Buller et al.
9,403,235 B2 8/2016 Buller et al.
9,418,193 B2 8/2016 Dowski, Jr. et al.
9,457,514 B2 10/2016 Schwärzler
9,469,057 B2 10/2016 Johnson et al.
9,478,063 B2 10/2016 Rhoads et al.
9,481,402 B1 11/2016 Muto et al.
9,486,878 B2 11/2016 Buller et al.
9,486,960 B2 11/2016 Paschkewitz et al.
9,502,993 B2 11/2016 Deng
9,525,262 B2 12/2016 Stuart et al.
9,533,526 B1 1/2017 Nevins
9,555,315 B2 1/2017 Aders
9,555,580 B1 1/2017 Dykstra et al.
9,557,856 B2 1/2017 Send et al.
9,566,742 B2 2/2017 Keating et al.
9,566,758 B2 2/2017 Cheung et al.
9,573,193 B2 2/2017 Buller et al.
9,573,225 B2 2/2017 Buller et al.

(56) References Cited

U.S. PATENT DOCUMENTS

| | | | |
|---|---|---|---|
| 9,586,290 | B2 | 3/2017 | Buller et al. |
| 9,595,795 | B2 | 3/2017 | Lane et al. |
| 9,597,843 | B2 | 3/2017 | Stauffer et al. |
| 9,600,929 | B1 | 3/2017 | Young et al. |
| 9,609,755 | B2 | 3/2017 | Coull et al. |
| 9,610,737 | B2 | 4/2017 | Johnson et al. |
| 9,611,667 | B2 | 4/2017 | GangaRao et al. |
| 9,616,623 | B2 | 4/2017 | Johnson et al. |
| 9,626,487 | B2 | 4/2017 | Jung et al. |
| 9,626,489 | B2 | 4/2017 | Nilsson |
| 9,643,361 | B2 | 5/2017 | Liu |
| 9,662,840 | B1 | 5/2017 | Buller et al. |
| 9,665,182 | B2 | 5/2017 | Send et al. |
| 9,672,389 | B1 | 6/2017 | Mosterman et al. |
| 9,672,550 | B2 | 6/2017 | Apsley et al. |
| 9,676,145 | B2 | 6/2017 | Buller et al. |
| 9,684,919 | B2 | 6/2017 | Apsley et al. |
| 9,688,032 | B2 | 6/2017 | Kia et al. |
| 9,690,286 | B2 | 6/2017 | Hovsepian et al. |
| 9,700,966 | B2 | 7/2017 | Kraft et al. |
| 9,703,896 | B2 | 7/2017 | Zhang et al. |
| 9,713,903 | B2 | 7/2017 | Paschkewitz et al. |
| 9,718,302 | B2 | 8/2017 | Young et al. |
| 9,718,434 | B2 | 8/2017 | Hector, Jr. et al. |
| 9,724,877 | B2 | 8/2017 | Flitsch et al. |
| 9,724,881 | B2 | 8/2017 | Johnson et al. |
| 9,725,178 | B2 | 8/2017 | Wang |
| 9,731,730 | B2 | 8/2017 | Stiles |
| 9,731,773 | B2 | 8/2017 | Gami et al. |
| 9,741,954 | B2 | 8/2017 | Bruder et al. |
| 9,747,352 | B2 | 8/2017 | Karmarkar |
| 9,764,415 | B2 | 9/2017 | Seufzer et al. |
| 9,764,520 | B2 | 9/2017 | Johnson et al. |
| 9,765,226 | B2 | 9/2017 | Dain |
| 9,770,760 | B2 | 9/2017 | Liu |
| 9,773,393 | B2 | 9/2017 | Velez |
| 9,776,234 | B2 | 10/2017 | Schaafhausen et al. |
| 9,782,936 | B2 | 10/2017 | Glunz et al. |
| 9,783,324 | B2 | 10/2017 | Embler et al. |
| 9,783,977 | B2 | 10/2017 | Alqasimi et al. |
| 9,789,548 | B2 | 10/2017 | Golshany et al. |
| 9,789,922 | B2 | 10/2017 | Dosenbach et al. |
| 9,796,137 | B2 | 10/2017 | Zhang et al. |
| 9,802,108 | B2 | 10/2017 | Aders |
| 9,809,977 | B2 | 11/2017 | Carney et al. |
| 9,817,922 | B2 | 11/2017 | Glunz et al. |
| 9,818,071 | B2 | 11/2017 | Jung et al. |
| 9,821,339 | B2 | 11/2017 | Paschkewitz et al. |
| 9,821,411 | B2 | 11/2017 | Buller et al. |
| 9,823,143 | B2 | 11/2017 | Twelves, Jr. et al. |
| 9,829,564 | B2 | 11/2017 | Bruder et al. |
| 9,846,933 | B2 | 12/2017 | Yuksel |
| 9,854,828 | B2 | 1/2018 | Langeland |
| 9,858,604 | B2 | 1/2018 | Apsley et al. |
| 9,862,833 | B2 | 1/2018 | Hasegawa et al. |
| 9,862,834 | B2 | 1/2018 | Hasegawa et al. |
| 9,863,885 | B2 | 1/2018 | Zaretski et al. |
| 9,870,629 | B2 | 1/2018 | Cardno et al. |
| 9,879,981 | B1 | 1/2018 | Dehghan Niri et al. |
| 9,884,663 | B2 | 2/2018 | Czinger et al. |
| 9,898,776 | B2 | 2/2018 | Apsley et al. |
| 9,914,150 | B2 | 3/2018 | Pettersson et al. |
| 9,919,360 | B2 | 3/2018 | Buller et al. |
| 9,931,697 | B2 | 4/2018 | Levin et al. |
| 9,933,031 | B2 | 4/2018 | Bracamonte et al. |
| 9,933,092 | B2 | 4/2018 | Sindelar |
| 9,957,031 | B2 | 5/2018 | Golshany et al. |
| 9,958,535 | B2 | 5/2018 | Send et al. |
| 9,962,767 | B2 | 5/2018 | Buller et al. |
| 9,963,978 | B2 | 5/2018 | Johnson et al. |
| 9,971,920 | B2 | 5/2018 | Derakhshani et al. |
| 9,976,063 | B2 | 5/2018 | Childers et al. |
| 9,987,792 | B2 | 6/2018 | Flitsch et al. |
| 9,988,136 | B2 | 6/2018 | Tiryaki et al. |
| 9,989,623 | B2 | 6/2018 | Send et al. |
| 9,990,565 | B2 | 6/2018 | Rhoads et al. |
| 9,994,339 | B2 | 6/2018 | Colson et al. |
| 9,996,890 | B1 | 6/2018 | Cinnamon et al. |
| 9,996,945 | B1 | 6/2018 | Holzer et al. |
| 10,002,215 | B2 | 6/2018 | Dowski et al. |
| 10,006,156 | B2 | 6/2018 | Kirkpatrick |
| 10,011,089 | B2 | 7/2018 | Lyons et al. |
| 10,011,685 | B2 | 7/2018 | Childers et al. |
| 10,012,532 | B2 | 7/2018 | Send et al. |
| 10,013,777 | B2 | 7/2018 | Mariampillai et al. |
| 10,015,908 | B2 | 7/2018 | Williams et al. |
| 10,016,852 | B2 | 7/2018 | Broda |
| 10,016,942 | B2 | 7/2018 | Mark et al. |
| 10,017,384 | B1 | 7/2018 | Greer et al. |
| 10,018,576 | B2 | 7/2018 | Herbsommer et al. |
| 10,022,792 | B2 | 7/2018 | Srivas et al. |
| 10,022,912 | B2 | 7/2018 | Kia et al. |
| 10,027,376 | B2 | 7/2018 | Sankaran et al. |
| 10,029,415 | B2 | 7/2018 | Swanson et al. |
| 10,040,239 | B2 | 8/2018 | Brown, Jr. |
| 10,046,412 | B2 | 8/2018 | Blackmore |
| 10,048,769 | B2 | 8/2018 | Selker et al. |
| 10,052,712 | B2 | 8/2018 | Blackmore |
| 10,052,820 | B2 | 8/2018 | Kemmer et al. |
| 10,055,536 | B2 | 8/2018 | Maes et al. |
| 10,058,764 | B2 | 8/2018 | Aders |
| 10,058,920 | B2 | 8/2018 | Buller et al. |
| 10,061,906 | B2 | 8/2018 | Nilsson |
| 10,065,270 | B2 | 9/2018 | Buller et al. |
| 10,065,361 | B2 | 9/2018 | Susnjara et al. |
| 10,065,367 | B2 | 9/2018 | Brown, Jr. |
| 10,068,316 | B1 | 9/2018 | Holzer et al. |
| 10,071,422 | B2 | 9/2018 | Buller et al. |
| 10,071,525 | B2 | 9/2018 | Susnjara et al. |
| 10,072,179 | B2 | 9/2018 | Drijfhout |
| 10,074,128 | B2 | 9/2018 | Colson et al. |
| 10,076,875 | B2 | 9/2018 | Mark et al. |
| 10,076,876 | B2 | 9/2018 | Mark et al. |
| 10,081,140 | B2 | 9/2018 | Paesano et al. |
| 10,081,431 | B2 | 9/2018 | Seack et al. |
| 10,086,568 | B2 | 10/2018 | Snyder et al. |
| 10,087,320 | B2 | 10/2018 | Simmons et al. |
| 10,087,556 | B2 | 10/2018 | Gallucci et al. |
| 10,099,427 | B2 | 10/2018 | Mark et al. |
| 10,100,542 | B2 | 10/2018 | GangaRao et al. |
| 10,100,890 | B2 | 10/2018 | Bracamonte et al. |
| 10,107,344 | B2 | 10/2018 | Bracamonte et al. |
| 10,108,766 | B2 | 10/2018 | Druckman et al. |
| 10,113,600 | B2 | 10/2018 | Bracamonte et al. |
| 10,118,347 | B2 | 11/2018 | Stauffer et al. |
| 10,118,579 | B2 | 11/2018 | Lakic |
| 10,120,078 | B2 | 11/2018 | Bruder et al. |
| 10,124,546 | B2 | 11/2018 | Johnson et al. |
| 10,124,570 | B2 | 11/2018 | Evans et al. |
| 10,137,500 | B2 | 11/2018 | Blackmore |
| 10,138,354 | B2 | 11/2018 | Groos et al. |
| 10,144,126 | B2 | 12/2018 | Krohne et al. |
| 10,145,110 | B2 | 12/2018 | Carney et al. |
| 10,151,363 | B2 | 12/2018 | Bracamonte et al. |
| 10,152,661 | B2 | 12/2018 | Kieser |
| 10,160,278 | B2 | 12/2018 | Coombs et al. |
| 10,161,021 | B2 | 12/2018 | Lin et al. |
| 10,166,752 | B2 | 1/2019 | Evans et al. |
| 10,166,753 | B2 | 1/2019 | Evans et al. |
| 10,171,578 | B1 | 1/2019 | Cook et al. |
| 10,173,255 | B2 | 1/2019 | TenHouten et al. |
| 10,173,327 | B2 | 1/2019 | Kraft et al. |
| 10,178,800 | B2 | 1/2019 | Mahalingam et al. |
| 10,179,640 | B2 | 1/2019 | Wilkerson |
| 10,183,330 | B2 | 1/2019 | Buller et al. |
| 10,183,478 | B2 | 1/2019 | Evans et al. |
| 10,189,187 | B2 | 1/2019 | Keating et al. |
| 10,189,240 | B2 | 1/2019 | Evans et al. |
| 10,189,241 | B2 | 1/2019 | Evans et al. |
| 10,189,242 | B2 | 1/2019 | Evans et al. |
| 10,190,424 | B2 | 1/2019 | Johnson et al. |
| 10,195,693 | B2 | 2/2019 | Buller et al. |
| 10,196,539 | B2 | 2/2019 | Boonen et al. |
| 10,197,338 | B2 | 2/2019 | Melsheimer |

(56) References Cited

U.S. PATENT DOCUMENTS 10,200,677 B2 2/2019 Trevor et al.
10,201,932 B2 2/2019 Flitsch et al.
10,201,941 B2 2/2019 Evans et al.
10,202,673 B2 2/2019 Lin et al.
10,204,216 B2 2/2019 Nejati et al.
10,207,454 B2 2/2019 Buller et al.
10,209,065 B2 2/2019 Estevo, Jr. et al.
10,210,662 B2 2/2019 Holzer et al.
10,213,837 B2 2/2019 Kondoh
10,214,248 B2 2/2019 Hall et al.
10,214,252 B2 2/2019 Schellekens et al.
10,214,275 B2 2/2019 Goehlich
10,220,575 B2 3/2019 Reznar
10,220,881 B2 3/2019 Tyan et al.
10,221,530 B2 3/2019 Driskell et al.
10,226,900 B1 3/2019 Nevins
10,232,550 B2 3/2019 Evans et al.
10,234,342 B2 3/2019 Moorlag et al.
10,237,477 B2 3/2019 Trevor et al.
10,252,335 B2 4/2019 Buller et al.
10,252,336 B2 4/2019 Buller et al.
10,254,499 B1 4/2019 Cohen et al.
10,257,499 B2 4/2019 Hintz et al.
10,259,044 B2 4/2019 Buller et al.
10,268,181 B1 4/2019 Nevins
10,269,225 B2 4/2019 Velez
10,272,860 B2 4/2019 Mohapatra et al.
10,272,862 B2 4/2019 Whitehead
10,275,564 B2 4/2019 Ridgeway et al.
10,279,580 B2 5/2019 Evans et al.
10,285,219 B2 5/2019 Feffatsidis et al.
10,286,452 B2 5/2019 Buller et al.
10,286,603 B2 5/2019 Buller et al.
10,286,961 B2 5/2019 Hillebrecht et al.
10,289,263 B2 5/2019 Troy et al.
10,289,875 B2 5/2019 Singh et al.
10,291,193 B2 5/2019 Dandu et al.
10,294,552 B2 5/2019 Liu et al.
10,294,982 B2 5/2019 Gabrys et al.
10,295,989 B1 5/2019 Nevins
10,303,159 B2 5/2019 Czinger et al.
10,307,824 B2 6/2019 Kondoh
10,310,197 B1 6/2019 Droz et al.
10,313,651 B2 6/2019 Trevor et al.
10,315,252 B2 6/2019 Mendelsberg et al.
10,336,050 B2 7/2019 Susnjara
10,337,542 B2 7/2019 Hesslewood et al.
10,337,952 B2 7/2019 Bosetti et al.
10,339,266 B2 7/2019 Urick et al.
10,343,330 B2 7/2019 Evans et al.
10,343,331 B2 7/2019 McCall et al.
10,343,355 B2 7/2019 Evans et al.
10,343,724 B2 7/2019 Polewarczyk et al.
10,343,725 B2 7/2019 Martin et al.
10,350,823 B2 7/2019 Rolland et al.
10,356,341 B2 7/2019 Holzer et al.
10,356,395 B2 7/2019 Holzer et al.
10,357,829 B2 7/2019 Spink et al.
10,357,957 B2 7/2019 Buller et al.
10,359,756 B2 7/2019 Newell et al.
10,369,629 B2 8/2019 Mendelsberg et al.
10,382,739 B1 8/2019 Rusu et al.
10,384,393 B2 8/2019 Xu et al.
10,384,416 B2 8/2019 Cheung et al.
10,389,410 B2 8/2019 Brooks et al.
10,391,710 B2 8/2019 Mondesir
10,392,097 B2 8/2019 Pham et al.
10,392,131 B2 8/2019 Deck et al.
10,393,315 B2 8/2019 Tyan
10,400,080 B2 9/2019 Ramakrishnan et al.
10,401,832 B2 9/2019 Snyder et al.
10,403,009 B2 9/2019 Mariampillai et al.
10,406,750 B2 9/2019 Barton et al.
10,412,283 B2 9/2019 Send et al.
10,416,095 B2 9/2019 Herbsommer et al.
10,421,496 B2 9/2019 Swayne et al.
10,421,863 B2 9/2019 Hasegawa et al.
10,422,478 B2 9/2019 Leachman et al.
10,425,793 B2 9/2019 Sankaran et al.
10,427,364 B2 10/2019 Alves
10,429,006 B2 10/2019 Tyan et al.
10,434,573 B2 10/2019 Buller et al.
10,435,185 B2 10/2019 Divine et al.
10,435,773 B2 10/2019 Liu et al.
10,436,038 B2 10/2019 Buhler et al.
10,438,407 B2 10/2019 Pavanaskar et al.
10,440,351 B2 10/2019 Holzer et al.
10,442,002 B2 10/2019 Benthien et al.
10,442,003 B2 10/2019 Symeonidis et al.
10,449,696 B2 10/2019 Elgar et al.
10,449,737 B2 10/2019 Johnson et al.
10,461,810 B2 10/2019 Cook et al.
2002/0112817 A1* 8/2002 Nemchick ..... B64C 1/066 156/285
2003/0150547 A1* 8/2003 Kesti ..... B29C 63/0047 156/212
2003/0183327 A1* 10/2003 Titze ..... B29C 63/02 156/212
2005/0015955 A1* 1/2005 Quell ..... B21D 39/021 29/243.58
2005/0061239 A1* 3/2005 Kyotani ..... B65G 49/0459 118/423
2006/0108783 A1 5/2006 Ni et al.
2006/0169398 A1* 8/2006 Haibistritinger ..... B29C 63/024 156/229
2007/0227645 A1* 10/2007 Habisreitinger ..... B29C 63/02 156/160
2007/0284046 A1* 12/2007 Habisreitinger ..... B65B 33/04 156/352
2008/0245124 A1 10/2008 Chaker et al.
2009/0301634 A1* 12/2009 Malecki ..... B23P 19/047 156/64
2010/0167038 A1* 7/2010 Linnenbrink ..... B29B 13/022 428/220
2011/0132548 A1 6/2011 Mattia
2013/0092325 A1* 4/2013 Genssen ..... B29C 70/388 156/580
2014/0277669 A1 9/2014 Nardi et al.
2017/0113344 A1 4/2017 Schönberg
2017/0341309 A1 11/2017 Piepenbrock et al.
2018/0016042 A1* 1/2018 Kimoto ..... B65B 11/18

FOREIGN PATENT DOCUMENTS

WO 1996038260 A1 12/1996
WO 2003024641 A1 3/2003
WO 2004108343 A1 12/2004
WO 2005093773 A1 10/2005
WO 2007003375 A1 1/2007
WO 2007110235 A1 10/2007
WO 2007110236 A1 10/2007
WO 2008019847 A1 2/2008
WO 2007128586 A3 6/2008
WO 2008068314 A2 6/2008
WO 2008086994 A1 7/2008
WO 2008087024 A1 7/2008
WO 2008107130 A1 9/2008
WO 2008138503 A1 11/2008
WO 2008145396 A1 12/2008
WO 2009083609 A2 7/2009
WO 2009098285 A1 8/2009
WO 2009112520 A1 9/2009
WO 2009135938 A1 11/2009
WO 2009140977 A1 11/2009
WO 2010125057 A2 11/2010
WO 2010125058 A1 11/2010
WO 2010142703 A2 12/2010
WO 2011032533 A1 3/2011
WO 2014016437 A1 1/2014
WO 2014187720 A1 11/2014
WO 2014195340 A1 12/2014
WO 2015193331 A1 12/2015
WO 2016116414 A1 7/2016

(56) References Cited

FOREIGN PATENT DOCUMENTS

| | | | |
|---|---|---|---|
| WO | 2017036461 | A1 | 3/2017 |
| WO | 2019030248 | A1 | 2/2019 |
| WO | 2019042504 | A1 | 3/2019 |
| WO | 2019048010 | A1 | 3/2019 |
| WO | 2019048498 | A1 | 3/2019 |
| WO | 2019048680 | A1 | 3/2019 |
| WO | 2019048682 | A1 | 3/2019 |

OTHER PUBLICATIONS

US 9,809,265 B2, 11/2017, Kinjo (withdrawn)
US 10,449,880 B2, 10/2019, Mizobata et al. (withdrawn)
International Search Report and Written Opinion dated Oct. 29, 2018, regarding PCT/US2018/039966.

* cited by examiner

AUTOMATED WRAPPING OF COMPONENTS IN TRANSPORT STRUCTURES

BACKGROUND

Field

The present disclosure relates generally to vehicles and other transport structures such as trucks, tractors, busses, trains, sea vessels, aircraft and spacecraft, and more specifically to automated techniques for wrapping vehicle components.

Background

Conventional approaches to enhancing the aesthetic effect of a transport structure such as a vehicle include painting. Painting can be expensive, and is not environmentally friendly. Hand-wrapping, which involves wrapping exterior vehicle panels with commercial off the shelf (COTS) wrap materials available in various colors, is commonly performed over a painted vehicle for customization. Hand-wrapping can also be used as an alternative to painting. For example, a vehicle may be taken to a body shop where the surface of the vehicle is manually wrapped to provide a different base color. In this case, the vehicle is already assembled. It is ordinarily impractical and expensive to disassemble the vehicle to apply wrapping to individual parts. Thus, the wrapping is conventionally applied on the outer surfaces, with the wrapping folded and trimmed around door edges and other areas in a best attempt to achieve an acceptable fit.

SUMMARY

Several aspects will be described more fully hereinafter with reference to various illustrative aspects of the present disclosure.

In one aspect of the disclosure, an apparatus for automated film wrapping of vehicle components includes a grabber arm mounted to a base at a first end and configured to grab a length of film from a feed roll and position the length of film over a vehicle component to be wrapped, a fixture configured to secure the vehicle component such that an exterior portion of the vehicle component faces the film, and an actuator coupled to the fixture and configured to controllably push the vehicle component into the film until the exterior portion is at least partially wrapped therein.

In another aspect of the disclosure, a system for automated film wrapping includes a first station including a grabber arm mounted to a base at a first end and configured to grab a length of film from a feed roll and drag the film into a position over a component to be wrapped, a fixture configured to secure the component and an actuator coupled to the fixture and configured to controllably push an exterior portion of the vehicle component into the film until the exterior portion is at least partially wrapped therewith.

In yet another aspect of the disclosure, a method for automated film wrapping includes grabbing, by an automated grabber arm, a length of film from a feed roll, dragging, by the automated grabber arm, the film into a position over the vehicle component to be wrapped, securing a component onto a fixture such that an exterior portion of the component faces the film, and controllably pushing, by an actuator coupled to the fixture, the component upward into the film until the exterior portion is at least partially wrapped therein.

It will be understood that other aspects of the disclosure will become readily apparent to those skilled in the art based on the following detailed description, wherein they are shown and described in only several embodiments by way of illustration. As will be appreciated by those skilled in the art, these vehicles, structures and techniques can be realized with other embodiments without departing from the spirit and scope of the invention. Accordingly, the drawings and detailed description are to be regarded as illustrative in nature and not as restrictive.

BRIEF DESCRIPTION OF THE DRAWINGS

Various illustrations of aspects of the present disclosure will now be presented in the detailed description by way of example, and not by way of limitation, in the accompanying drawings, wherein.

DETAILED DESCRIPTION

The detailed description set forth below in connection with the drawings is intended to provide a description of exemplary embodiments of the present invention. The description is not intended to represent the only embodiments in which the invention may be practiced. The terms "exemplary" and "example" used throughout this disclosure mean "serving as an example, instance, or illustration," and should not necessarily be construed as preferred or advantageous over other embodiments presented in this disclosure. The detailed description includes specific details for the purpose of providing a thorough and complete disclosure that fully conveys the scope of the invention to those skilled in the art. However, the invention may be practiced without these specific details. In some instances, well-known structures and components may be shown in block diagram form, or may be shown not drawn to scale, or omitted entirely, in order to avoid obscuring the various concepts presented throughout this disclosure.

An automated technique for the custom wrapping of vehicle components is presented to meet a variety of objectives and applications. An objective is to apply an aesthetic film surface to vehicle exterior and interior components utilizing COTS films for the process. Apart from improved aesthetics, these films may offer advanced UV protection and protective layers and/or coatings to significantly improve resistance to adverse environmental factors.

Among numerous other applications in the aftermarket and otherwise, the automated wrapping techniques as described have utility in the context of OEMs applying wrapping to parts that have yet to be assembled. This pre-assembly stage can enable the wrapping to be ideally achieved in a high quality manner, exploiting the flexibility associated with individual wrapping of components free from the confines of interconnected parts.

These films may be developed to have extended life to meet OEM specifications and customer expectations. The subject matter in this disclosure additionally may make it possible to wrap complex part geometries with the intent of limiting exposure to sunlight. For example, parts may be designed in a manner such that they have a lower proportion of horizontal surfaces otherwise having exposure areas to sunlight.

One aspect of an automated wrapping mechanism may include a grabber arm to extend the wrap and remove the backing, a movable fixture to secure a component and present it to the extended wrap, an actuator to move the component, via the fixture, into the wrap, and an applicator to secure the wrap to the component.

Figure 1:
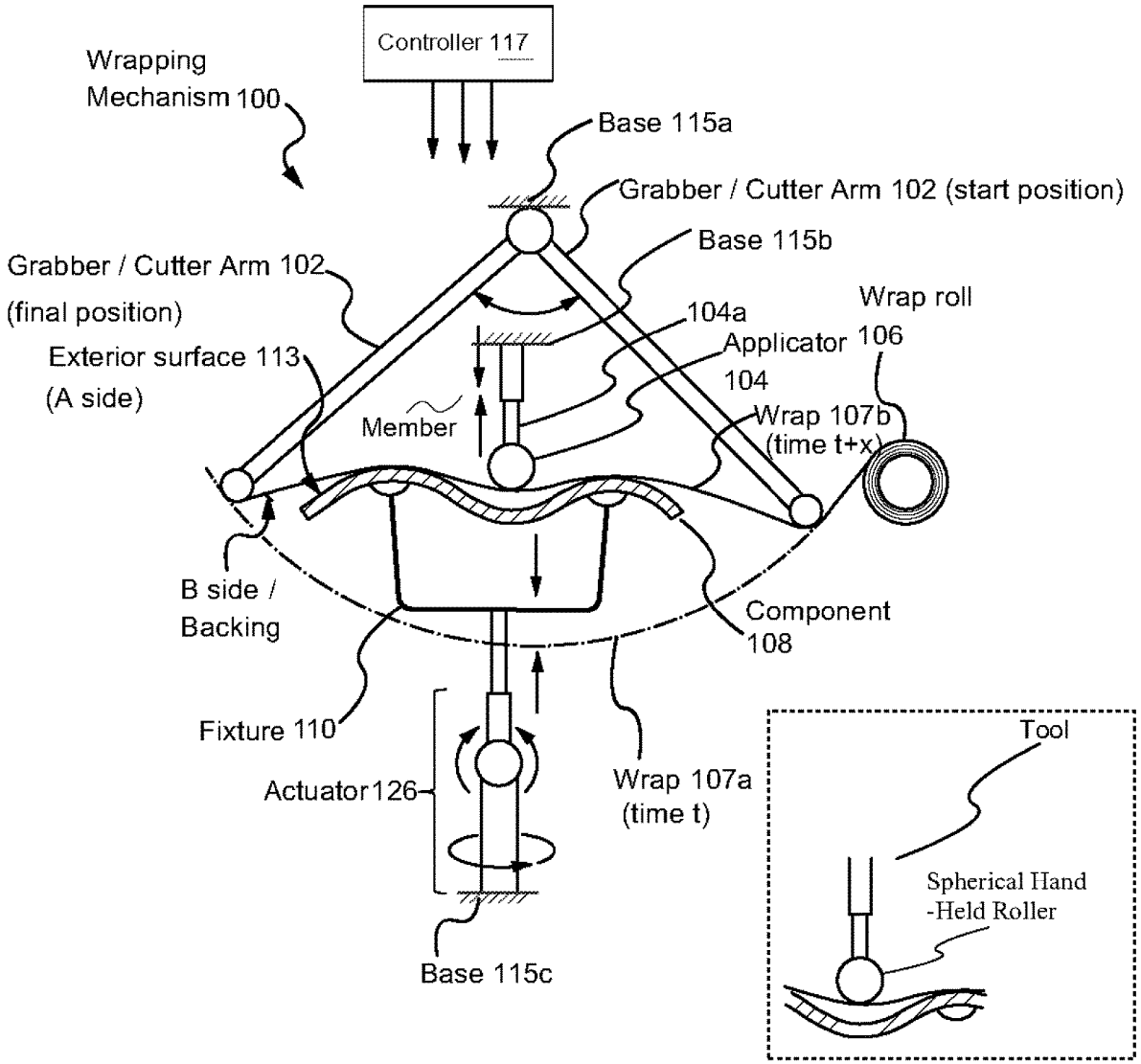
FIG. 1 is a side view of an automated vehicle wrapping mechanism in accordance with an embodiment.

FIG. 1 is a side view of an automated vehicle wrapping mechanism 100 in accordance with an embodiment. A component 108, such as a vehicle panel, may be secured onto a fixture mechanism 110, which may in turn be coupled to an actuator 126 of wrapper mechanism 100. The component 108 may be automatedly wrapped in response to controller commands using the automated wrapping mechanism 100. A standard material feed roll 106 may provide film/wrap material for the automated wrapping process.

In one aspect, the wrapping mechanism 100 includes a grabber arm 102 having a first end suspended from or otherwise mounted on a base 115*a* for handling the wrap roll 106. The grabber arm 102 is initially shown at a start position. The grabber arm picks up the film 107*a* and travels to a final position as shown. In traveling from the start position to the final position, the grabber arm extends the film 107*a* in an arc-like direction or other orientation to spread the film 107*a* relative to the component 108, thereby enveloping the part.

The grabber arm 102 may also remove the backing layer from the B-side of the wrap portion, e.g., using one or more tension rollers, thus preparing the wrap 107*a* for application as a film over the component. Wrap and film are herein used interchangeably.

As an example of these operations, the material feed may be controlled with tension rollers that control film (wrap) tension and remove backing from the film material. The grabber arm 102 may grab the end of the material 107*a* and drag it across the part 108 while controlling the tension of film to be applied. In other configurations, a separate tension roller or other device may be used to remove the backing from the wrap. In still other embodiments, more than one robotic arm is used to conduct one or more of the above operations.

In FIG. 1, wrap 107*a* is shown at an initial time t when the wrap is first taken from the roll 106, and wrap 107*b* shows the same spread wrap later at time t+x being applied onto the component 108.

The base 115*a* from which the grabber arm is suspended or mounted includes a common structural framework that extends to other devices in the wrapping mechanism 100. The structural framework may have an operating envelope defined by the travel capability of the arm in one or more directions. The parts to be wrapped may be those that are identified to fit within this envelope.

Further, while grabber arm 102 is shown as traveling in two positions, the grabber arm 102 may enjoy additional degrees of freedom and may move in more complex ways as necessary to accomplish the wrapping. The grabber arm 102 may utilize one or more appropriate effectors at a second end to handle the film during the wrapping operation. The effectors may be interchangeable. The grabber arm 102 may be telescopic in nature, such that the length and radii of the grabber arm 102 can be adjusted as the part 108 is wrapped.

A central control system may provide operating instructions to the grabber arm 102 and other devices. The central control system may include a synchronized controller 117 or processing system with one or more processors for executing the code that controls the grabber arm 102 and wrapping mechanism 100 in general, and memory to store the code. The fixture, actuator, grabber arm, hemming arm, cutting arm and other systems may be connected to a common structural framework via the base. (In other embodiments, a single arm may use one or more of a grabbing, cutting, or hemming effector per controller instruction.) The controller may provide information to the various systems based on part-specific programming, which may include pressure data for the actuators, applicators and components to be wrapped. Programmed code specific to the part being wrapped may take into account the part's properties and geometry, and may execute instructions based on this known information. Different applications corresponding to different part types can make the wrapping process highly efficient and amenable for use in a mass assembly setting, in contrast to conventional hand-wrapping techniques.

A component 108 to be wrapped may include an exterior surface or "A-side" 113 intended for assembly on an external portion of a transport structure. The hand-wrapping mechanism 100 may, however, be equally applicable to interior components where such use is desired. A custom fixture mechanism 110 may be used to handle the component 108 to be wrapped and to orient the component 108 (e.g., keep the component in a lowered position with the exterior surface facing upward) while the grabber arm(s) maintain the extended wrap 107*b* over the component.

The fixture 110 may be configured to properly support a specific type of component. The fixture 110, using an actuator mechanism as described below, may raise the component 108, e.g., upward toward the extended wrap 107*a* until the wrap contacts the exterior surface 113 and the wrap's adhesive B-side begins to adhere to the surface 113. At this point, the actuator 126 may continue applying gentle pressure until the initial wrap is substantially complete. In some embodiments, the actuator 126 may additionally or alternatively move the fixture 110 in one or more directions under controller command in order to facilitate an accurate and complete wrap. For example, the actuator 126 may move the component 108 sideways momentarily to enable the relevant side of the exterior portion 113 to more fully adhere to the wrap 107*b*.

The actuator 126 may alternatively move the fixture 110 to expose the component 108 in a manner that enables the grabber arm 102 in conjunction with an applicator 104, to perform more of the overall work in securing the wrap 107*b* over the component's exterior surface 113. The actuator 126 and grabber arm 102 may be cross-coupled to move based on feedback received from each other or they may otherwise be collectively coordinated under central command of the controller 117 to perform the wrapping in as efficiently and accurately a manner as possible.

The grabber arm 102 may be coupled to the applicator 104 via a common structural framework such as base 115*b* and/or 115*c*. The connection may be direct or indirect, e.g., through intermediary structures. The applicator may work in coordination with the actuator 126 or grabber arm 102 to apply downward pressure on the exterior surface 113 of the wrap 107*b* to smooth the wrap and expel trapped air. Motion of the grabber arm 102 and the applicator 104 can be coordinated in some embodiments, such that the applicator is instructed to activate at a certain time or in a certain position of component 108 or fixture 110.

In an embodiment, the applicator 104 may be a spherical roller, which may include an extendable arm 104*a* with a spherical rotating ball 104 at the end. The rotating ball 104 may move across the wrap 107*b* over the exterior surface 113 to compress the wrap 107*b* until it conforms to the shape of the component 108, thereby securing the wrap to the component 108. In other embodiments, the applicator function may be accomplished by a flat press or other actuator mechanism having a different shape and structure. As shown by the vertical arrows adjacent extendable arm 104*a*, the applicator may move up or down responsive to commands from the controller. Other directions are possible for more sophisticated applicators.

The applicator 104 may in various embodiments be fully or partially automated and may act in response to feedback from the controller. These movements and actions may be provide via controller instructions based on the type of part to be wrapped by the film. Various degrees of freedom of the applicator 104 may be used to perform the wrapping process depending on the complexity of the part.

In alternative embodiments, the applicator 104 may be structurally independent from other devices, and may employ a manual or hand-held roller. In an embodiment, a manual operation is performed in the wrapping process in which an operator uses a tool (such as a spherical hand-held roller) to ensure that the film conforms to the shape of the part without trapped air.

In an embodiment, automation is used to drive the wrapping process wherein parts with complex geometries are wrapped with the film. Instead of mechanical pressure delivered by the applicator 104 as illustrated in FIG. 1, pneumatic pressure (heat jet stream) may be used to wrap the film. The air used in this process may be heated such that its temperature is higher than the ambient temperature. The heated air may be provided directly by the applicator 104 (e.g., through a dedicated channel originating at the base 115*b* and terminating near the end of the applicator 104) or separately by another structure.

In some embodiments, the applicator 104 itself may be heated as well. In a fully automated embodiment, the wrapping operation may be performed in a controlled environment such as a structural chamber that encompasses bases 115*a-c* and the remaining equipment, wherein the ambient temperature of the environment may be elevated in a controlled manner to increase the quality of the wrapping.

In an embodiment, bespoke fixtures (e.g., fixture 110) are tailored to the parts being wrapped, and are implemented with a common fixture actuation mechanism 126. The fixture 110 can move upward and downward vertically in a one-axis (z) configuration as illustrated by the adjacent vertical arrows. The fixture 110 may be moved by actuator 126, for example, in an up-down configuration as shown by the vertical arrows adjacent fixture 110. Actuator 126 may be coupled to a common framework of the base 115*c* such that, in various embodiments, the actuator 126 can be configured to operate in concert with grabber arm 102 and applicator 104.

The actuator 126 may in some embodiments be configured to move the fixture 110 using additional degrees of freedom beyond the vertical (up-down) movement, as shown by the curved arrows adjacent actuator 126. In other embodiments, actuator 126 may be configured to rotate, as illustrated by the perspective circular arrow surrounding actuator 126. Using these additional degrees of freedom, the actuator 126 may orient the fixture 110 and hence the component 108 in different ways relative to the wrap 107*a-b* to help optimally secure the wrap 107*a-b* onto the component. These additional degrees of freedom can add significant functional flexibility to the wrapping mechanism 100 and can increase the integrity of the wrap. These additional degrees of freedom are especially helpful when wrapping complex geometries that may lack the smooth horizontal surfaces found on many panels. For more complex parts, the fixture could actuate about 2-axes, 3-axes or 5-axes. In an alternative embodiment, this actuation process may be automated, and would be coupled with the actuation of the top roller.

In some embodiments, the fixture 110 is operatively coupled to the applicator 104 so that the two actuating mechanisms can coordinate their respective movements to maintain an even pressure on the component 108, which can further increase accuracy and efficiency of the wrap. Thus, for example, if the applicator/roller 104 comes down to compress the part, the fixture 110 may move up to increase the compressive force. In an embodiment, these actuators may be fully automated while being operatively coupled under control of controller 117 or processor unit, all acting under the common structural framework of bases 115*b-c*. The controller 117 may additionally or alternatively be hardware based, in part or in whole, and may include digital signal processors and other dedicated hardware to provide commands and feedback to various portions of the wrapping mechanism. Fixtures and applicators having a wide variety of different structural and functional features may be designed for use with the controller for full automation. Different fixtures and applicators may be used for different types of components (which may include within its scope any component having one or more exterior surfaces for which wrapping is desired).

In some embodiments, the panel or other component is oriented properly and connected to the fixture 110 first, after which the component/fixture assembly is connected to the actuation mechanism 126. In an embodiment, the actuator 126 may be under manual control, either alone or with additional structures such as levers to raise the fixture 110.

The fixture 110 may be actuated to push the part into the film in a controlled manner. The applicator 104, e.g., the opposing spherical roller, may follow the contour of the part on the exterior surface 113 ensuring removal of any trapped air. The action of the applicator 104 may be coordinated with the actuator 126 acting on the fixture 110 to ensure that predetermined pressure is applied across the surface of the part 108. Manual (e.g., visual) or automated confirmation may be used to ensure that the region between the film and the part being wrapped is fully evacuated, as trapped air diminishes the aesthetic and mechanical properties of the film covering. The film bond can also fail because of trapped air.

In a related aspect of the disclosure, use of a wrapping mechanism is based on wrapping separate components to support production build processes, serviceability and reparability.

Once the part 108 is fully draped using any one or more of the embodiments described above, a cutting mechanism may traverse all around the part to ensure that the film is trimmed across all the edges, and the process returns to its original state, e.g., ready for the next wrapping process (or alternatively, ready for a hemming process). In various embodiments, the grabber arm can include a blade/cutting effector to perform the cutting operation. In some embodiments, the common structural framework of bases 115*a* and 115*c*, together with the controller 117, can provide more sophisticated movement to provide additional degrees of freedom to the operation. For example, a combination of the fixture 110 movement and the grabber/cutter arm (e.g., grabber arm 102 using a blade effector, or another arm dedicated to cutting) movement can result in a coordinated movement to perform a precise wrapping and cutting operation.

Figure 2:
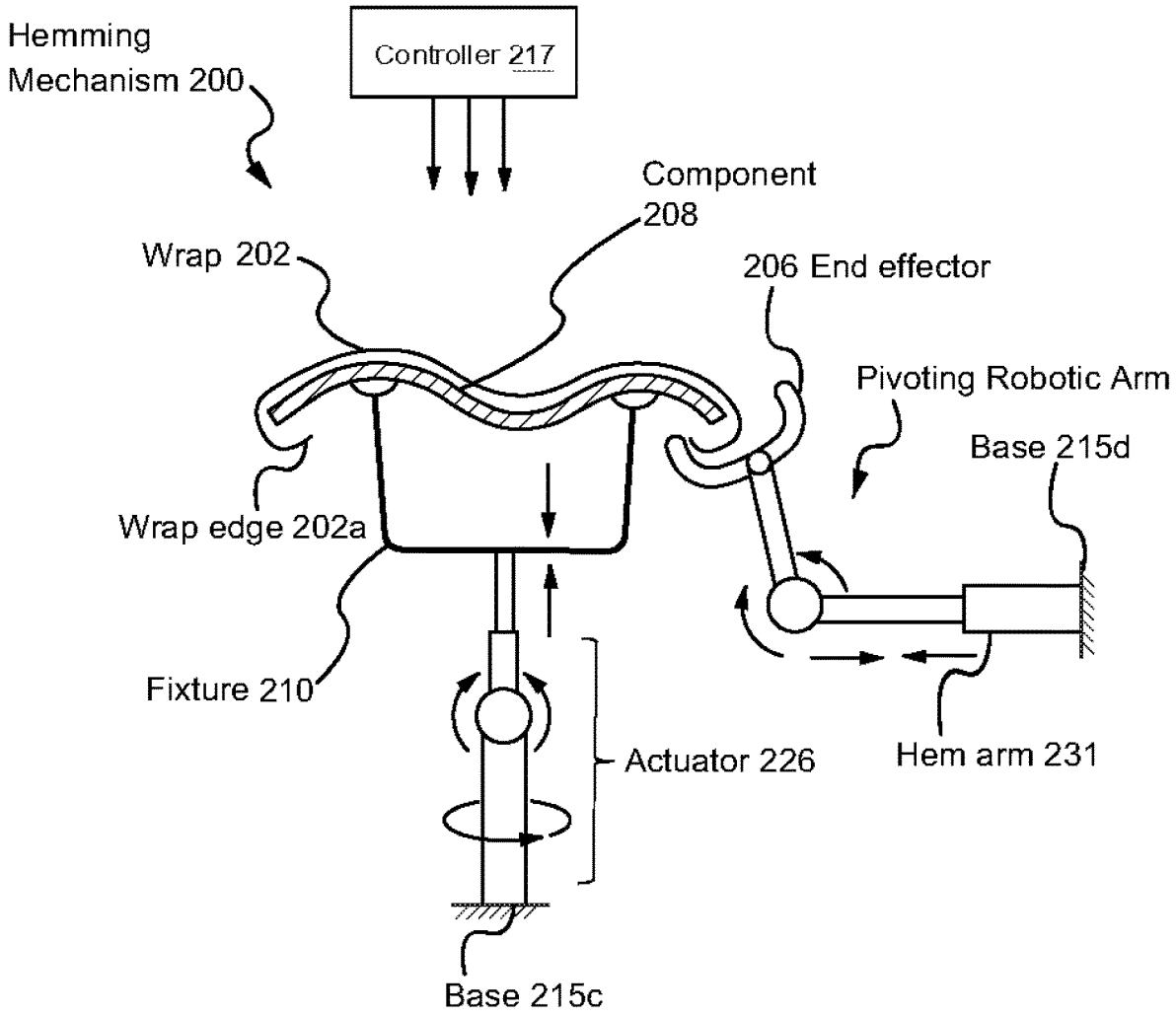
FIG. 2 is a side view of an automated vehicle hemming mechanism in accordance with an embodiment.

FIG. 2 is a side view of an automated vehicle hemming mechanism 200 in accordance with an embodiment. Following wrapping, a hemming operation may be employed to seal the edge of the wrap 202*a* around a respective edge of the component 208 using the fixture 210 and a soft hemming arm 231. The fixture 210 may be an identical fixture 110 as above, or the component 208 may be hemmed using different instruments, e.g., located at a dedicated hemming station to which a component is transported after the initial wrap. In an exemplary embodiment, the wrapping and hemming mechanisms are identical except that an additional arm (hem arm 231) is employed. Alternatively, after wrapping, grabber arm 102 may change effectors to one suitable for hemming. The hemming process may be manual or automated. The fixture 210 holding the part 208 to be wrapped may be used in both the wrapping and hemming operations by having acceptors configured to receive the same fixture.

In an embodiment, the hemming operation is automated. The fixture 210 supports the component. In an exemplary embodiment, a soft hemming arm 231 with a pressure-controlled end effector would traverse along the periphery of the part and hem the wrap edge 202*a* to an interior side of the component edge. In various embodiments, the wrap edge 202*a* is treated with another agent or adhesive to securably affix the wrap edge 202*a* to the component. In other embodiments, the end effector 206 simply applies pressure to the wrap edge 202*a* and adjacent areas of the swap 202 to achieve the hemming.

In an embodiment, the hemming arm 231 is mounted to a portion of the base 215*d*. Base 215*d* may be equivalent to the base 115*a* such that the hemming arm is mounted adjacent grabber arm 102. In embodiments where the hemming station is a physically distinct station, the hemming station may have its own controller 217, or it may be networked to receive instructions from controller 117 at a wrapping station for optimizing efficiency, or both.

During the hem, the component 208 is secured by fixture 210, which may be moved on the fly by the actuator 226 to ensure ideal positioning. In various embodiments, the hemming arm 231 is a five axis arm, in which case the hemming arm 231 can move upward, downward, and side-to-side, and can also rotate about its longitudinal axis. This freedom of movement of the end effector 206, along with the ability of actuator 226 to mobilize component 208 via fixture 210, enables the end effector 206 to be positioned very precisely based on instructions from controller 217 for highly accurate hems.

In still additional embodiments that may be especially suitable for more complex parts, the fixture actuation (see FIG. 1) and hemming arm actuation may be operably coupled. This coupling may also enable an integrated wrap/hem mechanism to wrap and hem concurrently. For example, a portion of the wrap that is complete may undergo processes of cutting and hemming, while the remainder of the wrap is secured to the component using the actuator 126 and applicator 104. In another embodiment, the hem is coordinated with the cut so that the wrapped part can be cut and hemmed simultaneously.

While panels of transport structures represent common examples of components for which wrapping is desired, the present disclosure is not so limited and essentially any component having an exterior portion or requiring a film akin to wrapping as described herein may be candidates for wrapping. Additionally, applications targeted specifically to optimizing the wrapping process for these complex components can be programmed into the controller. With the automated systems, ever more complex and geometrically diverse parts can become candidates for accurate and efficient wrapping.

Figure 3:
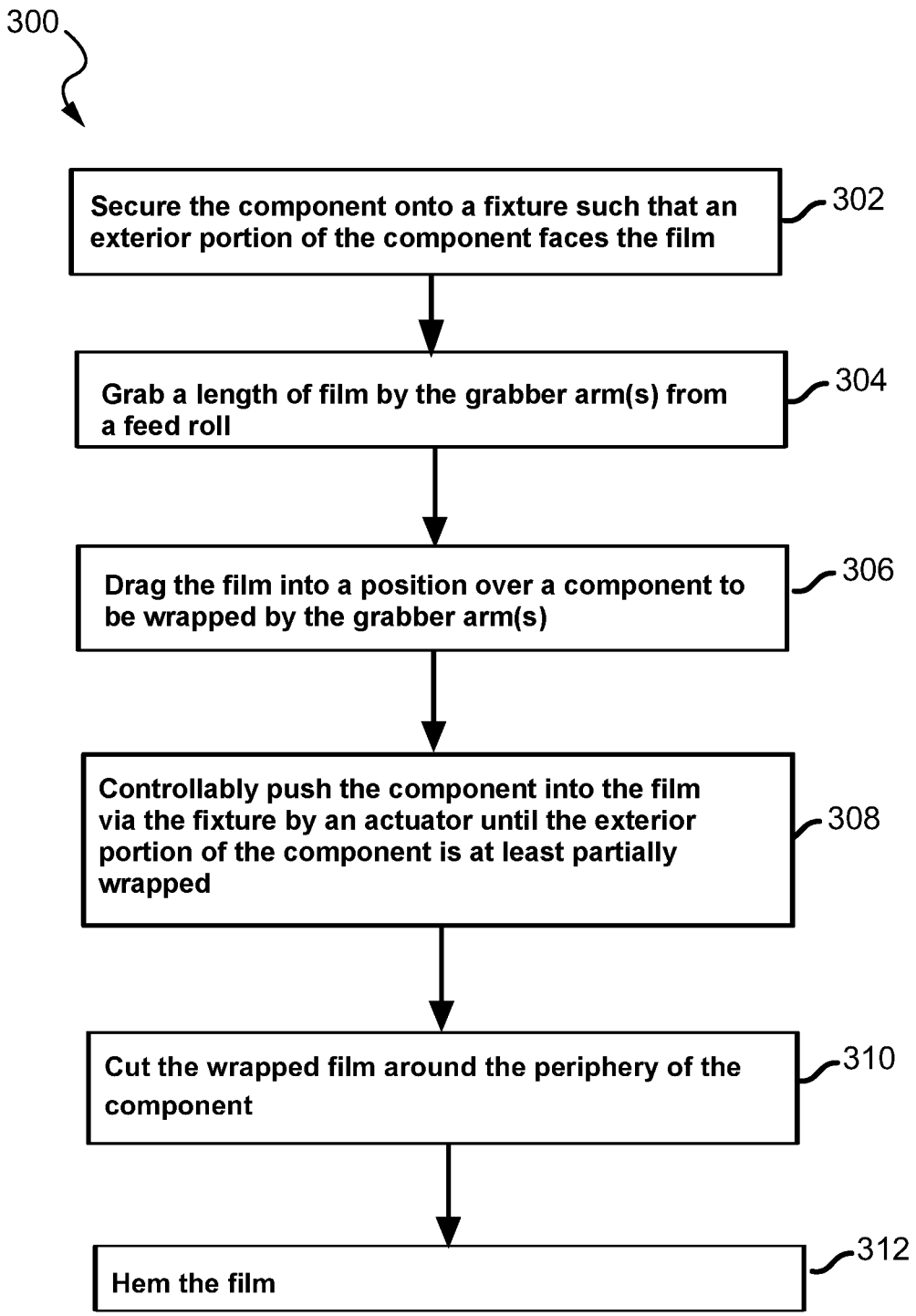
FIG. 3 is a flow diagram of a method for automated wrapping in accordance with an embodiment.

FIG. 3 is a flow diagram illustrating a method for wrapping a vehicle component in accordance with an embodiment. The component is secured onto the fixture to be used such that the exterior portion of the component faces the film (302). If necessary, the fixture is secured onto the actuator. Thereupon, the controller initiates the activity of the grabber arm, which grabs a length of film (wrap) from a feed roll (304). The grabber arm drags the film into position over the component mounted on the fixture (306). Next, the actuator controllably pushes the component into the film via the fixture until the exterior portion is at least partially wrapped with the film (308). An applicator may concurrently provide pressure to an opposite side of the film to remove trapped air. The wrapped film is then cut around the periphery of the component by the grabber arm or by a separate cutting mechanism (310). The film is then hemmed, by the same machine or, in some embodiments, at another station (312).

The previous description is provided to enable any person skilled in the art to practice the various aspects described herein. Various modifications to the exemplary embodiments presented throughout this disclosure will be readily apparent to those skilled in the art, and the concepts disclosed herein may be applied to other solar vehicles and for techniques for additively manufacturing structures within solar vehicles. Thus, the claims are not intended to be limited to the exemplary embodiments presented throughout the disclosure, but are to be accorded the full scope consistent with the language claims. All structural and functional equivalents to the elements of the exemplary embodiments described throughout this disclosure that are known or later come to be known to those of ordinary skill in the art are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112(f), or analogous law in applicable jurisdictions, unless the element is expressly recited using the phrase "means for" or, in the case of a method claim, the element is recited using the phrase "step for."

What is claimed is:

1. An apparatus for automated film wrapping of vehicle components, comprising:

a grabber arm mounted to a base at a first end and configured to grab a length of film from a feed roll and configured to position the length of film over a vehicle component to be wrapped based on moving the grabber arm and film from a first position to a second position in an arc-like direction thereby enveloping the vehicle component;

a fixture configured to secure the vehicle component such that an exterior portion of the vehicle component faces the film; and an actuator coupled to the fixture and configured to controllably push the vehicle component into the film until the exterior portion is at least partially wrapped therein, and wherein the actuator is further configured to move in a vertical motion, a pivot motion and a rotational motion.

2. The apparatus of claim 1, wherein the grabber arm is coupled to a tension roller at a second end and is configured to grab and position the length of film using the tension roller.

3. The apparatus of claim 1, wherein the grabber arm is configured to position the length of film using an arc-like motion over the vehicle component prior to the actuator pushing the vehicle component upward.

4. The apparatus of claim 1, wherein the grabber arm is further configured to apply a desired tension between ends of the length of film.

5. The apparatus of claim 1, wherein the grabber arm is configured to remove backing from a side of the length of film facing the exterior portion of the vehicle component.

6. The apparatus of claim 1, further comprising a member including a roller arranged at an end thereof, the member positioned above the fixture and configured to use the roller to press down on the length of film and remove trapped air by following a contour of the exterior portion.

7. The apparatus of claim 6, wherein the roller comprises a spherical shape.

8. The apparatus of claim 6, wherein an opposing end of the member is coupled to the base.

9. The apparatus of claim 6, wherein movements of the member and the actuator are automatedly coordinated to maintain a pre-determined pressure across the exterior portion.

10. The apparatus of claim 6, further comprising a control device configured to terminate an operation of the actuator and member in response to receiving confirmation that the trapped air is evacuated from the at least partially wrapped exterior portion.

11. The apparatus of claim 10, wherein the confirmation is received from a machine or person in visual or tactile contact with the at least partially wrapped exterior portion.

12. The apparatus of claim 1, further comprising at least one cutter configured to traverse around a perimeter of the vehicle component and trim the length of film at each edge of the exterior portion.

13. The apparatus of claim 1, further comprising a pivoting robotic arm configured to hem the length of film at each edge of the exterior portion.

14. The apparatus of claim 13, wherein an end of the robotic arm proximate the vehicle component comprises a multi-axis soft hemming arm having a pressure-controlled end effector for traversing a perimeter of the exterior portion to perform hemming operations.

15. The apparatus of claim 13, wherein hemming operations use the fixture to secure the vehicle component.

16. The apparatus of claim 13, wherein the pivoting robotic arm is coupled to the base.

17. The apparatus of claim 13, wherein movement of the fixture by the actuator is automatedly coordinated with movement of the pivoting robotic arm to coordinate wrapping and hemming operations.

18. The apparatus of claim 1, wherein the grabber arm is configured to use effectors compatible with either or both of wrapping and hemming operations.

19. The apparatus of claim 1, further comprising an applicator configured to deliver pneumatic pressure to effect wrapping the exterior portion.

20. The apparatus of claim 19, wherein the applicator is heated an above ambient temperature.

21. The apparatus of claim 19, wherein the applicator comprises a plurality of degrees of freedom.

22. The apparatus of claim 19, wherein movement of the applicator is automated by a controller.

23. The apparatus of claim 1, wherein the actuator is configured to move the fixture along one axis.

24. The apparatus of claim 1, wherein the actuator is configured to move the fixture along a plurality of axes.

25. The apparatus of claim 1, further comprising a tool configured to be used by a manual operator during the wrapping to ensure that the film conforms to a shape of the exterior portion without trapped air bubbles.

26. The apparatus of claim 25, wherein the tool comprises a spherical hand-held roller.

27. A system for automated film wrapping, comprising;

a first station including:

a grabber arm mounted to a base at a first end and configured to grab a length of film from a feed roll and configured to drag the film into a position over a component to be wrapped based on moving the grabber arm and film from a first position to a second position in an arc-like direction thereby enveloping the component;

a fixture configured to secure the component; and an actuator coupled to the fixture and configured to controllably push an exterior portion of a vehicle component into the film until the exterior portion is at least partially wrapped therewith, and wherein the actuator is further configured to move in a vertical motion, a pivot motion and a rotational motion.

28. The system of claim 27, wherein the grabber arm is coupled to a tension roller at a second end and is configured to grab and position the length of film using the tension roller.

29. The system of claim 27, wherein the grabber arm is configured to remove backing from a side of the length of film facing the exterior portion of the component.

30. The system of claim 27, wherein the first station further comprises a member including a roller arranged at an end thereof, the member positioned above the fixture and configured to use the roller to press down on the length of film and remove trapped air by following a contour of the exterior portion.

31. The system of claim 30, wherein the roller comprises a spherical shape.

32. The system of claim 30, wherein an opposing end of the member is coupled to the base.

33. The system of claim 30, wherein movements of the member and the actuator are automatedly coordinated to maintain a pre-determined pressure across the exterior portion.

34. The system of claim 30, wherein the first station further comprises a control device configured to terminate an operation of the actuator and member in response to receiving confirmation that the trapped air is evacuated from the at least partially wrapped exterior portion.

35. The system of claim 34, wherein the confirmation is received from a machine or person in visual or tactile contact with the at least partially wrapped exterior portion.

36. The system of claim 27, wherein the first station comprises at least one cutter configured to traverse around a perimeter of the component and trim a length of film at each edge of the exterior portion.

37. The system of claim 27, wherein the first station further comprises a pivoting robotic arm configured to hem the at least partially wrapped film at edges of the exterior portion.

38. The system of claim 37, wherein an end of the pivoting robotic arm proximate the vehicle component comprises a multi-axis soft hemming arm having a pressure-controlled end effector for traversing a perimeter of the exterior portion to perform hemming operations.

39. The system of claim 27, further comprising a second station, the second station comprising a pivoting robotic arm configured to hem the at least partially wrapped film.

40. The system of claim 27, wherein the grabber arm is configured to use effectors compatible with either or both of wrapping and hemming operations.

41. The system of claim 27, wherein the first station further comprises an applicator configured to deliver pneumatic pressure to effect wrapping the exterior portion.

42. The system of claim 41, wherein the applicator comprises a plurality of degrees of freedom.

43. The system of claim 41, wherein movement of the applicator is automated by a controller.

44. The system of claim 27, further comprising a tool configured to be used by a manual operator during the wrapping to ensure that the film conforms to a shape of the exterior portion with trapped air being evacuated.

45. The system of claim 44, wherein the tool comprises a spherical hand-held roller.

46. A method for automated film wrapping, comprising:

receiving a component on a fixture such that an exterior portion of the component faces the film;

grabbing, by an automated grabber arm, a length of film from a feed roll;

dragging, by the automated grabber arm, the film into a position over the component, wherein the automated grabber arm and film are moved from a first position to a second position in an arc-like direction thereby dragging the film and enveloping the component;

and controllably pushing, by an actuator coupled to the fixture, the component into the film until the exterior portion is at least partially wrapped therein, and wherein the actuator is further configured to move in a vertical motion, a pivot motion and a rotational motion.

47. The method of claim 46, wherein the grabbing and dragging by the automated grabber arm comprises using a tension roller at an end of the at least one grabber arm.

* * * * *